US010646917B2

(12) United States Patent
Mori et al.

(10) Patent No.: US 10,646,917 B2
(45) **Date of Patent: *May 12, 2020**

(54) COPPER INGOT, COPPER WIRE MATERIAL, AND METHOD FOR PRODUCING COPPER INGOT

(71) Applicant: MITSUBISHI MATERIALS CORPORATION, Tokyo (JP)

(72) Inventors: Satoru Mori, Naka-gun (JP); Eiho Watanabe, Iwaki (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 599 days.

This patent is subject to a terminal disclaimer.

(21) Appl. No.: 15/120,813

(22) PCT Filed: Nov. 28, 2014

(86) PCT No.: PCT/JP2014/081538

§ 371 (c)(1),
(2) Date: Aug. 23, 2016

(87) PCT Pub. No.: WO2015/136789

PCT Pub. Date: Sep. 17, 2015

(65) Prior Publication Data

US 2016/0361760 A1 Dec. 15, 2016

(30) Foreign Application Priority Data

Mar. 14, 2014 (JP) ..... 2014-052593

(51) Int. Cl.
*B22D 11/00* (2006.01)
*B22D 11/06* (2006.01)
(Continued)

(52) U.S. Cl.
CPC ..... *B22D 11/004* (2013.01); *B21B 1/18* (2013.01); *B22D 1/00* (2013.01); *B22D 1/007* (2013.01);
(Continued)

(58) Field of Classification Search
CPC ... B22D 11/0602; B22D 11/004; B22D 11/00; B22D 11/005; B22D 11/11;
(Continued)

(56) References Cited

U.S. PATENT DOCUMENTS 3,161,541 A 12/1964 Holub
3,947,363 A * 3/1976 Pryor ..... B01D 39/2093 210/510.1
(Continued)

FOREIGN PATENT DOCUMENTS

CN 1334155 A 2/2002
CN 1422716 6/2003
(Continued)

OTHER PUBLICATIONS

Machine translation of JP-2001049369-A, 9 pages. (Year: 2001).*
(Continued)

*Primary Examiner* — Matthew E. Hoban
*Assistant Examiner* — Lynne Edmondson
(74) *Attorney, Agent, or Firm* — Locke Lord LLP

(57) ABSTRACT

A copper ingot of the present invention which is casted by a belt-caster type continuous casting apparatus includes: 1 ppm by mass or less of carbon; 10 ppm by mass or less of oxygen; 0.8 ppm by mass or less of hydrogen; 15 ppm by mass to 35 ppm by mass of phosphorus; and a balance of Cu and inevitable impurities, and includes inclusions formed of oxides containing carbon, phosphorus, and Cu.

5 Claims, 3 Drawing Sheets

(51) Int. Cl.

| | |
|---|---|
| ***B22D 11/11*** | (2006.01) |
| ***B22D 11/14*** | (2006.01) |
| ***B22D 7/00*** | (2006.01) |
| ***C22C 9/00*** | (2006.01) |
| ***C22C 32/00*** | (2006.01) |
| ***B22D 11/12*** | (2006.01) |
| ***B22D 1/00*** | (2006.01) |
| ***B22D 11/108*** | (2006.01) |
| ***B21B 1/18*** | (2006.01) |
| ***B22D 11/119*** | (2006.01) |
| *B21B 1/46* | (2006.01) |
| *B21B 3/00* | (2006.01) |

(52) U.S. Cl.
CPC ..... *B22D 7/005* (2013.01); *B22D 11/0602* (2013.01); *B22D 11/108* (2013.01); *B22D 11/119* (2013.01); *B22D 11/1206* (2013.01); *B22D 11/144* (2013.01); *C22C 9/00* (2013.01); *B21B 1/463* (2013.01); *B21B 2003/005* (2013.01)

(58) Field of Classification Search
CPC ..... B22D 11/119; B22D 11/144; B22D 7/005; C22C 9/00; C22C 32/0021; C22F 1/08; C22F 1/00
USPC ..... 148/432; 29/527.5
See application file for complete search history.

(56) References Cited

U.S. PATENT DOCUMENTS

| | | | | |
|---|---|---|---|---|
| 3,987,224 | A | 10/1976 | Brinkmann et al. | |
| 5,667,752 | A * | 9/1997 | Suzuki | C22C 9/00 420/494 |
| 5,885,376 | A * | 3/1999 | Suzuki | C22C 9/04 148/400 |
| 6,682,824 | B1 | 1/2004 | Koshiba et al. | |
| 9,679,676 | B2 * | 6/2017 | Koide | H01B 1/026 |
| 2005/0247384 | A1 | 11/2005 | Jacobsen et al. | |
| 2006/0292029 | A1 | 12/2006 | Aoyama et al. | |
| 2008/0196550 | A1 | 8/2008 | Abe et al. | |
| 2010/0206513 | A1 * | 8/2010 | Hattori | B22D 11/004 164/462 |
| 2011/0120594 | A1 | 5/2011 | Uno et al. | |
| 2011/0123389 | A1 * | 5/2011 | Shindo | C22C 9/00 420/499 |

FOREIGN PATENT DOCUMENTS

| | | | | |
|---|---|---|---|---|
| CN | 1833813 | A | | 9/2006 |
| EP | 2210687 | A1 | | 7/2010 |
| JP | 57-005834 | A | | 1/1982 |
| JP | 58-179549 | A | | 10/1983 |
| JP | 01-246334 | A | | 10/1989 |
| JP | 02-232327 | A | | 9/1990 |
| JP | 06-212300 | A | | 8/1994 |
| JP | 2001049369 | A | * | 2/2001 |
| JP | 2001-297629 | A | | 10/2001 |
| JP | 3235237 | B2 | | 12/2001 |
| JP | 2002-086261 | A | | 3/2002 |
| JP | 2003-253357 | A | | 9/2003 |
| JP | 2006-028642 | A | | 2/2006 |
| JP | 2007-038252 | A | | 2/2007 |
| JP | 2007-050440 | A | | 3/2007 |
| JP | 2010-174351 | A | | 8/2010 |
| JP | 2010-234442 | A | | 10/2010 |
| JP | 4593397 | B2 | | 12/2010 |
| JP | 2011-003745 | A | | 1/2011 |
| WO | 2011/118009 | A1 | | 9/2011 |

OTHER PUBLICATIONS

Supplementary European Search Report dated Jun. 20, 2017, issued for the European patent application No. 14885776.6.
Office Action dated Mar. 8, 2017, issued for the Chinese patent application No. 201480067567.9 and English translation thereof.
International Search Report dated Feb. 24, 2015, issued for PCT/JP2014/081538 and English translation thereof.
International Search Report dated Oct. 22, 2013, issued for PCT/JP2013/073154 and English translation thereof.
Office Action dated Oct. 13, 2015, issued for the Japanese patent application No. 2012-192136 and English translation thereof.
Office Action dated Dec. 21, 2015, issued for the Chinese patent application No. 201380039894.9 and English translation thereof.
Office Action dated Apr. 8, 2016, issued for U.S. Appl. No. 14/419,398.
Notice of Allowance dated Aug. 2, 2016, issued for the Japanese patent application No. 2012-192136 and English translation thereof.
Final Office Action dated Oct. 24, 2016, issued for U.S. Appl. No. 14/419,398.

* cited by examiner

EDX ANALYSIS RESULTS(ATOMIC%)

| | ① | ② | ③ |
|---|---|---|---|
| CARBON | 55.65 | 54.66 | 53.22 |
| OXYGEN | 4.7 | 5.9 | 5.8 |
| PHOSPHORUS | 0.46 | 0.62 | 0.52 |
| COPPER | 39.19 | 38.82 | 40.46 |
| TOTAL | 100 | 100 | 100 |
| PARTICLE DIAMETER | 0.2μm | 0.8μm | 0.5μm |

COPPER INGOT, COPPER WIRE MATERIAL, AND METHOD FOR PRODUCING COPPER INGOT

TECHNICAL FIELD

The present invention relates to a copper ingot which is cast by a belt-caster type continuous casting apparatus, a copper wire material which is formed from this copper ingot, and a method for producing a copper ingot.

Priority is claimed on Japanese Patent Application No. 2014-052593, filed Mar. 14, 2014, the content of which is incorporated herein by reference.

BACKGROUND ART

For example, a copper wire material formed of low-oxygen copper such as tough pitch copper containing approximately 0.02 mass % to 0.05 mass % of oxygen or oxygen-free copper having an oxygen content of 10 ppm by mass or less, may be provided as a copper wire material used in a wire of an electrical wire, a lead wire, a magnet wire of a motor, or the like. Here, in a case of using a copper wire material for welding, for example, hydrogen embrittlement may occur when the oxygen content is great. Therefore, a copper wire material formed of low-oxygen copper such as oxygen-free copper is used.

Conventionally, the copper wire material described above is manufactured by dip forming or extrusion. In the dip forming, molten copper is continuously solidified on the outer periphery of a copper seed rod to obtain a rod-like copper material and this is rolled to obtain a copper wire material. In the extrusion, a billet of copper is subjected to extrusion and rolled or the like to obtain a copper wire material. However, in such manufacturing methods, productivity is poor and the production cost is high.

As a method for producing a copper wire material with a low production cost, a method performed by continuous casting rolling using a belt-caster type continuous casting apparatus (belt-wheel type continuous casting apparatus) and a continuous rolling apparatus may be used, as disclosed in PTL 1, for example. In this continuous casting rolling method, which is a method of cooling and solidifying molten copper melted in a large-sized melting furnace such as a shaft furnace to obtain a copper ingot and continuously withdrawing and rolling this copper ingot, mass production can be realized with a large-scale plant.

However, in a case where low-oxygen copper such as oxygen-free copper is manufactured as an ingot, a hydrogen concentration in molten copper increases and air bubbles of water vapor are generated. In addition, since a mold is rotationally moved in a belt-caster type continuous casting apparatus (belt-wheel type continuous casting apparatus), the generated air bubbles are difficult to remove from the surface of the molten copper and remains in the copper ingot, so that void defects are generated.

It is considered that such void defects remaining in the copper ingot are a main cause of surface defects of a copper wire material. The surface defects of the copper wire material causes surface defects in a drawn wire material, even in a case where a drawn wire material is obtained by executing a drawing process. In a case where this drawn wire material is used as a conductor of a magnet wire and an enamel coat (insulating film) is applied to the surface of the drawn wire material, water or oil remaining in a surface defect of the drawn wire material is retained in the enamel coat, and a defect called a "blister" of blistering of the enamel coat due to generation of air bubbles in the enamel coat, when heat is applied after drying the enamel coat, may occur.

In order to prevent generation of void defects in a copper ingot and surface defects in a copper wire material, PTL 2, for example, discloses a copper ingot which is manufactured by adding a phosphorous compound to molten copper so that the phosphorous content of an ingot becomes 1 ppm to 10 ppm and adjusting a temperature of the molten copper in a tundish to 1085° C. to 1100° C., and a copper wire material.

However, in the copper wire material disclosed in PTL 2, since the amount of phosphorus is as low as 1 ppm to 10 ppm, it is difficult to fix oxygen in the molten copper as the phosphorous compound and it is difficult to sufficiently prevent generation of air bubbles of water vapor. Accordingly, it is difficult to prevent generation of void defects in the copper ingot and to sufficiently reduce surface defects generated in a copper wire material.

Meanwhile, PTL 3 does not disclose a casting using a belt-caster type continuous casting apparatus (belt-wheel type continuous casting apparatus), but proposes a technology of promoting a reaction between oxygen and carbon to improve deoxidation efficiency, by bubbling an inert gas into a molten metal launder in which a solid reducing agent such as charcoal powder is disposed on a surface of molten copper in a method for producing P-containing low-oxygen copper in which the oxygen content is 10 ppm or less and to which 10 ppm to 140 ppm of phosphorus is added. In PTL 3, gas components in the molten copper are determined by a partial pressure balancing method, but PTL 3 does not disclose gas components in the copper ingot.

CITATION LIST

Patent Literature

[PTL 1] Japanese Unexamined Patent Application, First Publication No. 2007-050440

[PTL 2] Japanese Unexamined Patent Application, First Publication No. 2007-038252

[PTL 3] Japanese Patent No. 3235237

SUMMARY OF INVENTION

Technical Problem

However, as disclosed in PTL 3, it is difficult to sufficiently inhibit void defects in a copper ingot manufactured by a belt-caster type continuous casting apparatus, just by decreasing the amount of oxygen in the molten copper by simply adding phosphorus.

In the casting method disclosed in PTL 3, since a comparatively large amount of phosphorus which is 10 ppm to 140 ppm is contained, it is possible to sufficiently fix oxygen in the molten copper at the time of casting by using phosphorus, but the electrical conductivity may be significantly lower in the copper ingot due to a solid solution of phosphorus in copper.

The invention is made in consideration of these circumstances and an object thereof is to provide a copper ingot which is cast by a belt-caster type continuous casting apparatus and in which the number of void defects is reliably decreased, a copper wire material which is formed from this copper ingot and in which generation of surface defects is prevented, and a method for producing this copper ingot.

Solution to Problem

In order to solve such problems and achieve the above-mentioned object, the inventors have found the followings as a result of research.

A position of a void defect in a copper ingot cast by a belt-caster type continuous casting apparatus was determined by transmission X-rays, this void defect was opened by drilling in a vacuum state, and the gas released from the void defect was analyzed by a mass spectrometer. The results were that CO and $CO_2$ were detected together with $H_2$ and $H_2O$. As a result of analyzing the inner surface of the void defect by Auger electron spectroscopy (AES), carbon and oxygen were detected.

From the analysis results described above, in a copper ingot cast by a belt-caster type continuous casting apparatus, it was confirmed that not only hydrogen and oxygen contained in the molten copper, but also the carbon significantly affects generation of void defects.

In general, in a case of casting a copper ingot by a belt-caster type continuous casting apparatus, a solid reducing agent (charcoal powder or the like) is put on the molten copper in a tundish storing the molten copper, and oxidation of the molten copper is prevented. Accordingly, the solid reducing agent may be mixed into or dissolved in the molten copper. Carbon dissolved in the molten copper is crystallized as carbon particles, when a temperature of the molten copper is decreased. Therefore, the mixed in carbon powder or crystallized carbon particles remain in the molten copper supplied to a mold as solids.

It is thought that, in a process of solidifying the molten copper in a mold, the carbon powder or the carbon particles react with oxygen, CO and $CO_2$ gas are generated, and voids are formed. Since the carbon powder or the carbon particles remain in the molten copper as solids, bubbles of CO and $CO_2$ gas are generated even in a state where the oxygen partial pressure is low. A large void defect having a diameter of 1 mm or more may be formed due to hydrogen or water vapor being incorporated into this void.

Herein, in a typical continuous casting mold disclosed in PTL 3, since the carbon powder or the carbon particles in the molten copper rise up and are separated, hardly any void defects caused by carbon are generated. On the other hand, in a belt-caster type continuous casting apparatus, since hardly any carbon powder or carbon particles in the molten copper rise up and separate in the mold, void defects caused by carbon may be formed as described above.

The present inventions have been made based on the above-mentioned findings, and there is provided a copper ingot of the present invention which is casted by a belt-caster type continuous casting apparatus, the copper ingot including: 1 ppm by mass or less of carbon; 10 ppm by mass or less of oxygen; 0.8 ppm by mass or less of hydrogen; 15 ppm by mass to 35 ppm by mass of phosphorus; and a balance of Cu and inevitable impurities, wherein the copper ingot includes inclusions formed of oxides containing carbon, phosphorus, and Cu.

In the copper ingot having this configuration, since the amount of oxygen is set to be 10 ppm by mass or less, the amount of hydrogen is set to be 0.8 ppm by mass or less, and the amount of carbon is set to be 1 ppm by mass or less, it is possible to prevent formation of void defects caused by hydrogen, oxygen, and carbon.

Since the amount of phosphorus is 15 ppm by mass to 35 ppm by mass, it is possible to sufficiently reduce the amount of oxygen with phosphorus.

Since the inclusions formed of oxides containing carbon, phosphorus, and Cu are present, it is possible to prevent crystallization of carbon particles in the molten copper by fixing carbon in the molten copper by phosphorus, and it is possible to prevent formation of void defects caused by carbon. Even when the amount of phosphorus is as comparatively large as 15 ppm by mass to 35 ppm by mass, it is possible to reduce the amount of phosphorus available to form a solid solution in copper and to prevent a significant decrease in electrical conductivity.

Since the copper ingot is produced by a belt-caster type continuous casting apparatus, it is possible to significantly decrease the production cost.

Here, in the copper ingot of the invention, it is preferable that the electrical conductivity be 98% IACS or more.

In this case, since the copper alloy has an electrical conductivity of 98% IACS or more which is equivalent to that of typical oxygen-free copper, it is possible to use this copper ingot as an alternative material for oxygen-free copper.

There is provided a copper wire material of the present invention which is formed by processing the copper ingot described above, and the copper wire material has a composition including: 1 ppm by mass or less of carbon; 10 ppm by mass or less of oxygen; 0.8 ppm by mass or less of hydrogen; 15 ppm by mass to 35 ppm by mass of phosphorus; and a balance of Cu and inevitable impurities.

Since the copper wire material having this configuration is formed from the copper ingot in which generation of void defects is prevented, it is possible to prevent generation of surface defects.

In addition, since the copper ingot produced by a belt-caster type continuous casting apparatus is used, it is possible to significantly decrease the production cost.

There is provided a method of the present invention for producing the copper ingot described above, wherein a ceramic foam filter is installed between a tundish which supplies molten copper to the belt-caster type continuous casting apparatus, and a casting launder which transports molten copper to the tundish, and wherein the method including: in the casting launder, using carbon powder as a solid reducing agent and setting a molten copper temperature to be in a range of 1085° C. or higher and lower than 1100° C.; and in the tundish, setting the molten copper temperature to be in a range of 1100° C. to 1150° C. without using a solid reducing agent and adding phosphorus.

In the method for producing the copper ingot having this configuration, since carbon powder is used as a solid reducing agent and the molten copper temperature is set to be in a range of 1085° C. or higher and lower than 1100° C. in the casting launder, it is possible to decrease the oxygen content by using the solid reducing agent and to prevent carbon from dissolution into the molten copper.

Since a ceramic foam filter is installed between the casting launder and the tundish, it is possible to remove the carbon powder mixed into the casting launder and to prevent carbon powder from being mixed into the molten copper in the tundish.

In addition, since the molten copper temperature in the tundish is set to be as comparatively high as 1100° C. to 1150° C., it is possible to prevent crystallization of carbon particles in the molten copper. Further, since the molten copper temperature is maintained at a high temperature, it is possible to allow a reaction between carbon and P before crystallization.

Accordingly, it is possible to prevent carbon powder or carbon particles from existing in the molten copper in the tundish as solids, and to prevent formation of voids due to CO and $CO_2$.

ADVANTAGEOUS EFFECTS OF INVENTION

According to the present invention, it is possible to provide a copper ingot which is casted by a belt-caster type continuous casting apparatus and in which the number of void defects can be reliably lowered, a copper wire material which is formed of this copper ingot and in which generation of surface defects is prevented, and a method for producing this copper ingot.

DESCRIPTION OF EMBODIMENTS

Figure 1:
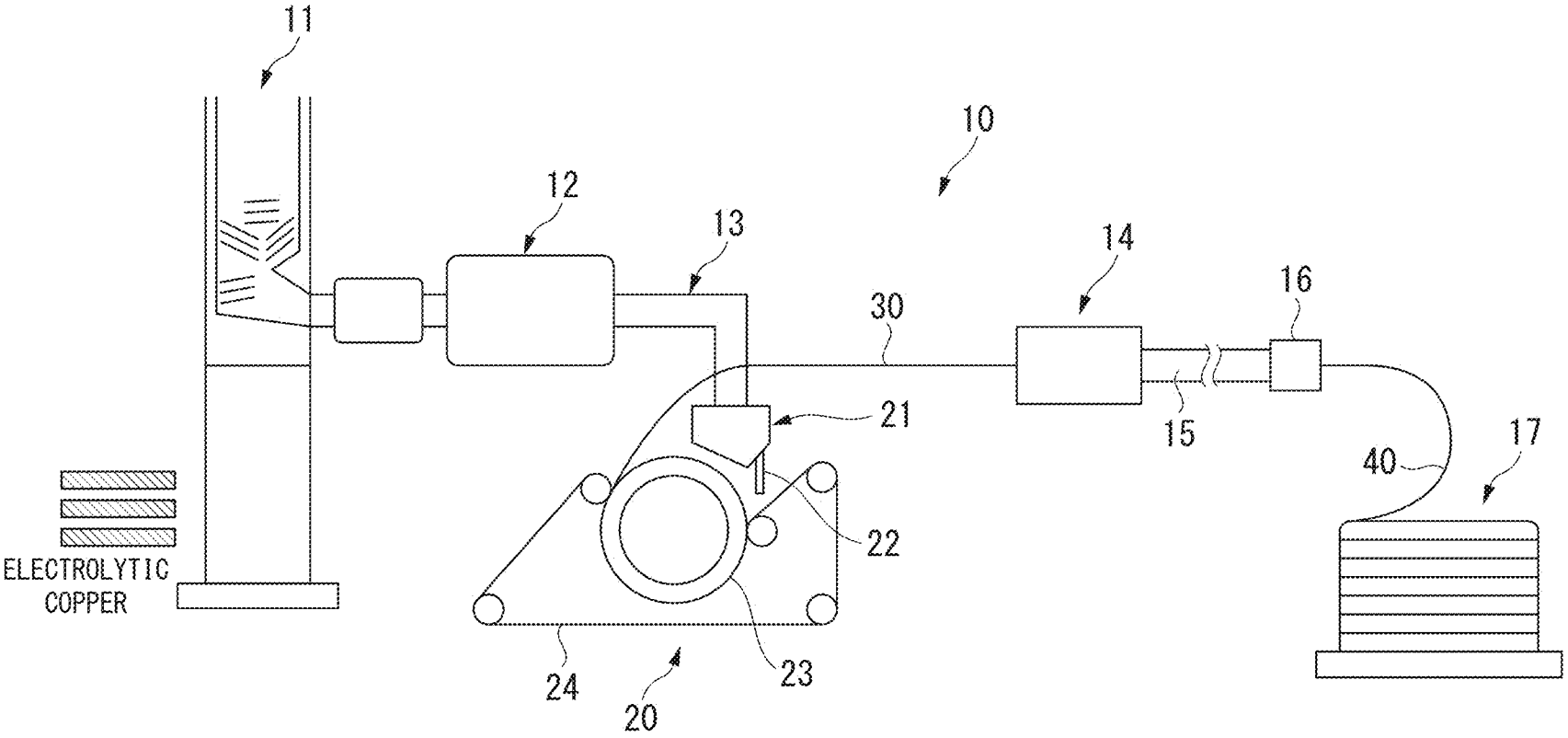
FIG. 1 is a schematic explanatory diagram of a continuous casting rolling apparatus including a belt-caster type continuous casting apparatus and a continuous rolling apparatus which produce a copper ingot and a copper wire material according to the embodiments of the present invention.

Hereinafter, a copper ingot, a copper wire material, and a method for producing a copper ingot of the embodiments of the present invention will be described with reference to the accompanied drawings.

A copper ingot 30 and a copper wire material 40 of the present embodiment have a composition including: 1 ppm by mass or less of carbon; 10 ppm by mass or less of oxygen; 0.8 ppm by mass or less of hydrogen; 15 ppm by mass to 35 ppm by mass of phosphorus; and a balance of Cu and inevitable impurities, and include inclusions formed of oxides containing carbon, phosphorus, and Cu therein.

In addition, in the copper ingot 30 and the copper wire material 40 of the present embodiment, the electrical conductivity is set to be 98% IACS or more.

Here, a reason of regulating the amount of each element as described above will be described.

(Carbon: 1 ppm by Mass or Less)

When the amount of carbon exceeds 1 ppm by mass, CO gas and $CO_2$ gas are generated and voids are easily generated. Accordingly, the amount of carbon is regulated to be 1 ppm by mass or less. In order to further prevent generation of CO gas and $CO_2$ gas, the amount of carbon is preferably 0.7 ppm by mass or less. In addition, the amount of carbon is preferably 0.2 ppm by mass or more, in order to form the inclusions formed of oxides containing carbon, phosphorus, and Cu.

(Oxygen: 10 ppm by Mass or Less)

When the amount of oxygen exceeds 10 ppm by mass, generation of $H_2O$ gas, CO gas, and $CO_2$ gas causing the voids may be promoted. Accordingly, the amount of oxygen is regulated to be 10 ppm by mass or less. In order to further prevent generation of $H_2O$ gas, CO gas, and $CO_2$ gas, the amount of oxygen is preferably 8 ppm by mass or less. The lower limit of the amount of oxygen is preferably 1 ppm by mass, but there is no limitation thereof.

(Hydrogen: 0.8 ppm by Mass or Less)

When the amount of hydrogen exceeds 0.8 ppm by mass, generation of $H_2$ gas and $H_2O$ gas causing the voids may be promoted. Accordingly, the amount of hydrogen is regulated to be 0.8 ppm by mass or less. In order to further prevent generation of $H_2$ gas and $H_2O$ gas, the amount of hydrogen is preferably 0.6 ppm by mass or less. The lower limit of the amount of hydrogen is preferably 0.1 ppm by mass, but there is no limitation thereof (Phosphorus: 15 ppm by Mass to 35 ppm by Mass)

Phosphorus has an operation effect of decreasing the oxygen content in the molten copper by generating a phosphorous oxide by reacting with oxygen in the molten copper. In addition, phosphorus has an operation effect of preventing generation of CO gas and $CO_2$ gas by fixing carbon in the molten copper by generating an oxide containing carbon, phosphorus, and copper. Meanwhile, phosphorus may significantly decrease the electrical conductivity due to solid solution in the copper.

Therefore, the amount of phosphorus is set in a range of 15 ppm by mass to 35 ppm by mass. In order to reliably realize the operation effects described above, the amount of phosphorus is preferably 20 ppm by mass to 30 ppm by mass.

As shown in FIG. 1, the copper ingot 30 and the copper wire material 40 of the present embodiment are produced by a continuous casting rolling apparatus 10 including a belt-caster type continuous casting apparatus (belt-wheel type continuous casting apparatus 20) and a continuous rolling apparatus 14.

Here, the continuous casting rolling apparatus 10 which produces the copper ingot 30 and the copper wire material 40 according to the present embodiment will be described.

The continuous casting rolling apparatus 10 includes a melting furnace 11, a holding furnace 12, a casting launder 13, the belt-wheel type continuous casting apparatus 20, a continuous rolling apparatus 14, and a coiler 17.

The holding furnace 12 temporarily stores the molten copper produced by the melting furnace 11 while holding the molten copper at a predetermined temperature and transports a certain amount of molten copper to the casting launder 13.

The casting launder 13 transports the molten copper transported from the holding furnace 12 to a tundish 21 disposed over the belt-wheel type continuous casting apparatus 20.

A pouring nozzle 22 is disposed on a termination side of the tundish 21 in a flowing direction of the molten copper, and the molten copper in the tundish 21 is supplied through the pouring nozzle 22 to the belt-wheel type continuous casting apparatus 20.

The belt-wheel type continuous casting apparatus 20 includes a casting wheel 23 including a groove formed on an outer peripheral surface, and an endless belt 24 which moves around the casting wheel 23 so as to come into contact with a part of the outer peripheral surface of the casting wheel 23. The copper ingot 30 is continuously casted by injecting and cooling the supplied molten copper to the space formed between the groove and the endless belt 24 through the pouring nozzle 22.

The belt-wheel type continuous casting apparatus 20 is connected to the continuous rolling apparatus 14.

The continuous rolling apparatus 14 continuously rolls the copper ingot 30 produced from the belt-wheel type continuous casting apparatus 20 as a rolled material to produce the copper wire material 40 having a predetermined outer diameter. The copper wire material 40 produced from the continuous rolling apparatus 14 is coiled by the coiler 17 through a cleaning and cooling device 15 and a flaw detector 16.

The cleaning and cooling device 15 cools the copper wire material 40 produced from the continuous rolling apparatus 14 while cleaning the surface thereof by a cleaning agent such as alcohol.

The flaw detector 16 detects surface flaw of the copper wire material 40 transported from the cleaning and cooling device 15.

Figure 2:
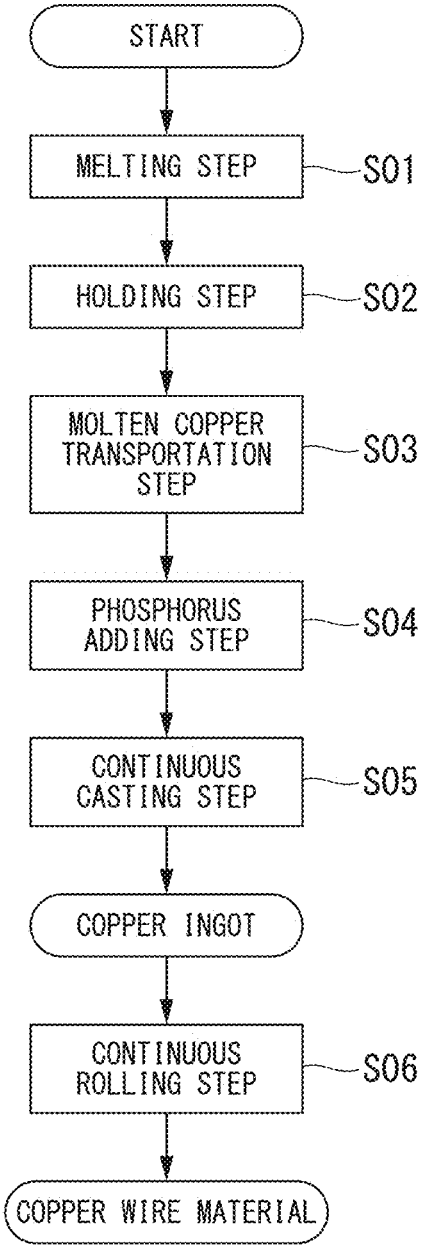
FIG. 2 is a flowchart of a method for producing a copper ingot and a method for producing a copper wire material according to the embodiments.

Hereinafter, the producing method of the copper ingot 30 and the copper wire material 40 using the continuous casting rolling apparatus 10 having the configuration described above will be described with reference to FIG. 1 and FIG. 2.

First, an electrolytic copper of 4N (purity of 99.99 mass % or more) is put and melted in the melting furnace 11 and molten copper is obtained (melting step S01). In this melting step S01, the inner portion of the melting furnace 11 is turned into a reducing atmosphere by adjusting an air fuel ratio of a plurality of burners of the shaft furnace.

The molten copper obtained by the melting furnace 11 is transported to the holding furnace 12 and held at a predetermined temperature (holding step S02). In this holding furnace 12, hydrogen in the molten copper is removed by increasing the oxygen content in the molten copper.

Next, the molten copper in the holding furnace 12 is transported to the tundish 21 through the casting launder 13 (molten copper transportation step S03). In the embodiment, a solid reducing agent (carbon powder) is put in the casting launder 13 and deoxidization of the molten copper is performed. Here, in order to prevent dissolution of carbon in the molten copper, the molten copper temperature in the casting launder 13 is set to be in a range of 1085° C. or higher and lower than 1100° C.

A ceramic foam filter having high alumina quality is installed between the casting launder 13 and the tundish 21 and the solid reducing agent (carbon powder) mixed into the molten copper is removed.

Phosphorus is added to the molten copper in the tundish 21 (phosphorus adding step S04). At that time, the molten copper temperature in the tundish 21 is set to be in a range of 1100° C. to 1150° C., in order to prevent crystallization of solid carbon particles from the molten copper. In addition, oxidization of the molten copper is prevented by setting the atmosphere in the tundish 21 to the CO gas atmosphere without using the solid reducing agent.

The molten copper is supplied to a space (mold) formed between the casting wheel 23 and the endless belt 24 of the belt-wheel type continuous casting apparatus 20 from the tundish 21 through the pouring nozzle 22, and is cooled to solidified, and the copper ingot 30 is produced (continuous casting step S05). In the continuous casting step S05, the crystallization of carbon is prevented by quenching the molten copper. In the embodiment, the cross section of the produced copper ingot 30 is set to an approximately trapezoidal shape having a height of approximately 50 mm and a width of approximately 100 mm.

The copper ingot 30 continuously produced by the belt-wheel type continuous casting apparatus 20 is supplied to the continuous rolling apparatus 14. The copper ingot 30 is rolled by the continuous rolling apparatus 14 and the copper wire material 40 having a circular cross section is produced (continuous rolling step S06).

The produced copper wire material 40 is cleaned and cooled by the cleaning and cooling device 15, the flaws are detected by the flaw detector 16, and the copper wire material 40 having no problems with quality is coiled by the coiler 17.

In the copper ingot 30 and the copper wire material 40 according to the present embodiment having such the configurations described above, since the amount of oxygen is regulated to be 10 ppm by mass or less, the amount of hydrogen is regulated to be 0.8 ppm by mass or less, the amount of carbon is regulated to be 1 ppm by mass or less, it is possible to prevent formation of the void defects caused by oxygen, hydrogen, and carbon and surface defects caused by the void defects.

Since the amount of phosphorus is 15 ppm by mass to 35 ppm by mass, it is possible to sufficiently decrease the oxygen content by phosphorus.

Since inclusions formed of oxides containing carbon, phosphorus, and Cu is present, it is possible to prevent formation of void defects caused by carbon, by fixing carbon by phosphorus. The diameter of the inclusion is preferably 0.1 μm to 6 μm and the inclusions are preferably dispersed so that 0.1 to 5 inclusions are observed in a visual field of 50 μm×50 μm, that is, dispersed so as to be 40 to 2000/mm$^2$. More specifically, in a case where the copper ingot is cut and a sample cross section obtained by etching the cut surface with Ar ions is observed by magnifying using a scanning electron microscope by 30,000 times, the inclusions are preferably dispersed so that 0.1 to 5 inclusions are observed in a visual field of 50 μm×50 μm. Even when the amount of phosphorus is as comparatively large as 15 ppm by mass to 35 ppm by mass, it is possible to decrease the amount of phosphorus forming a solid-solution in copper and to prevent a significant decrease in electrical conductivity.

Since the copper ingot 30 and the copper wire material 40 is produced using the continuous casting rolling apparatus 10 including the belt-wheel type continuous casting apparatus 20 which is one type of the belt-caster type continuous casting apparatus and the continuous rolling apparatus 14, it is possible to significantly decrease the production cost thereof.

Since the copper ingot 30 and the copper wire material 40 of the present embodiment have an electrical conductivity of 98% IACS or more which is equivalent to that of the typical oxygen-free copper, it is possible to use them as an alternative material for oxygen-free copper.

In the present embodiment, since the molten copper temperature of the casting launder 13 is set to be as comparatively low as 1085° C. or higher and lower than 1100° C., it is possible to prevent dissolution of carbon in the molten copper in the casting launder 13.

Since the ceramic foam filter is arranged between the casting launder 13 and the tundish 21, it is possible to remove carbon powder mixed into the molten copper.

Since the molten copper temperature of the tundish 21 is set to be as comparatively high as 1100° C. to 1150° C., it is possible to prevent crystallization of carbon particles. As a result, carbon in the molten copper reacts with P.

As described above, since solid carbon is prevented from existing in the molten copper, it is possible to prevent generation of void defects caused by CO gas and $CO_2$ gas.

Hereinabove, the embodiment of the present invention has been described, but the present invention is not limited thereto and can be suitably modified within a range not departing from the technical ideas of the invention.

For example, in the embodiment, an example using the belt-wheel type continuous casting apparatus has been described, but there is no limitation thereof, and other belt-wheel type continuous casting apparatuses such as a twin-belt type casting apparatus can be used.

In the embodiment, an example of producing the copper ingot and the copper wire material using electrolytic copper of 4N as a melting raw material has been described, but there is no limitation thereof, and a copper wire material may be produced using pure copper scrap such as tough pitch copper or oxygen-free copper as a raw material.

The sectional shape or size of the copper ingot is not limited and a wire diameter of the copper wire material is not limited to the embodiment, either.

EXAMPLE

Hereinafter, results of confirmatory experiment performed for confirming effectiveness of the present invention will be described.

In the confirmatory experiment, the continuous casting rolling apparatus 10 shown in FIG. 1 was used, the producing conditions were varied, and copper ingots (sectional area: 4000 $mm^2$) and copper wire materials (wire diameter: 8.0 mm) of Invention Examples 1 to 3 and Comparative Examples 1 to 5 were prepared.

In each of Invention Examples 1 to 3, as disclosed in the embodiment, the molten copper temperature of the casting launder 13 was set to be in a range of 1085° C. or higher and lower than 1100° C., the ceramic foam filter was installed between the casting launder 13 and the tundish 21, the molten copper temperature of the tundish 21 was set to be in a range of 1100° C. to 1150° C., phosphorus (Cu—P compound) was added thereto, and then continuous casting rolling was performed. The mixing ratio of air in butane combustion in the melting furnace 11, the holding furnace 12, the casting launder 13, and the tundish was suitably adjusted to adjust the oxygen concentration to 5 ppm by mass to 9 ppm by mass and the hydrogen concentration to 0.4 ppm by mass to 0.7 ppm by mass in the molten copper in the tundish 21.

In Comparative Example 1, the molten copper temperature of the casting launder 13 was controlled to be 1100° C. to 1150° C., the ceramic foam filter was installed between the casting launder 13 and the tundish 21, the molten copper temperature of the tundish 21 was controlled to be 1085° C. or higher and lower than 1100° C., phosphorus (Cu—P compound) was added in the tundish 21, and then continuous casting rolling was performed.

In Comparative Example 2, the molten copper temperature of the tundish 21 was controlled to be 1100° C. to 1150° C. and the other conditions were set to be the same as the conditions of Comparative Example 1.

In Comparative Example 3, the ceramic foam filter was not installed, but the other conditions were set to be the same as the conditions of the present invention. In each of Comparative Examples 1 to 3, a mixing ratio of air in butane combustion in the melting furnace 11, the holding furnace 12, the casting launder 13, and the tundish 21 was suitably adjusted to adjust the oxygen concentration to 5 ppm by mass to 6 ppm by mass and the hydrogen concentration to 0.4 ppm by mass to 0.5 ppm by mass in the molten copper in the tundish 21.

In each of Comparative Examples 4 to 6, the molten copper temperature of the casting launder 13 was controlled to be 1085° C. or higher and lower than 1100° C., the ceramic foam filter was installed, and the molten copper temperature of the tundish 21 was controlled to be 1100° C. to 1150° C. In addition, a mixing ratio of air in butane combustion in the melting furnace 11, the holding furnace 12, the casting launder 13, and the tundish 21 was suitably adjusted to adjust the oxygen concentration and the hydrogen concentration in the molten copper in the tundish 21.

In Comparative Example 7, the phosphorous concentration was increased by increasing the amount of phosphorus added in the tundish 21, and the other conditions were set to be the same as the conditions of the present invention.

In Comparative Example 8, the molten copper temperature of the tundish 21 was controlled to be 1085° C. or higher and lower than 1100° C., the concentration of phosphorus added in the tundish 21 was decreased, and continuous casting rolling was performed.

First, the carbon content, the oxygen content, the hydrogen content, the phosphorous content, and the electrical conductivity of the obtained copper wire material were measured. The measurement results are shown in Table 1.

The carbon content was measured by a glow discharge mass spectrometer (VG-9000) manufactured by VG Microtrace Limited.

The hydrogen content was measured by an inert gas melting gas chromatography separation thermal conductivity measuring method using a hydrogen analysis device (RHEN-600 type) manufactured by LECO Corporation.

The oxygen content was measured by an inert gas melting infrared ray absorption method using an oxygen analysis device (RO-600 type) manufactured by LECO Corporation.

The phosphorous content was measured by a spark discharge emission spectrometric analysis method using ARL 4460 manufactured by Thermo Fisher Scientific Inc.

The carbon content, the oxygen content, the hydrogen content, and the phosphorous content of 100 g of the copper wire material produced after the operation of the continuous casting rolling was stabilized, were measured.

The electrical conductivity was measured by a double bridge method using a precision type double bridge manufactured by Yokogawa Electric Corporation. The electrical conductivity of 80 g of the copper wire material produced after the operation state of the continuous casting rolling was stabilized, was measured.

Next, the number of void defects of the obtained copper ingot was measured. The copper ingot was cut to have a thickness (casting direction thickness) of 2 mm and the number of void defects having a diameter of 1 mm or more was measured by transmission X rays. The measurement results are shown in Table 1. This measurement was performed with respect to a copper ingot which was obtained by melting 20 tons of copper and produced immediately after the operation state of the continuous casting rolling was stabilized, and a copper ingot which was produced immediately before completing the continuous casting rolling, and the average value of measurement values of both ingots was shown as the number of void defects of the copper ingot in Table 1.

In addition, the surface defects of the obtained copper wire material were detected by an eddy-current flaw detector and the number of surface defects per 5 tons was measured. The measurement results are shown in Table 1.

Figure 3:
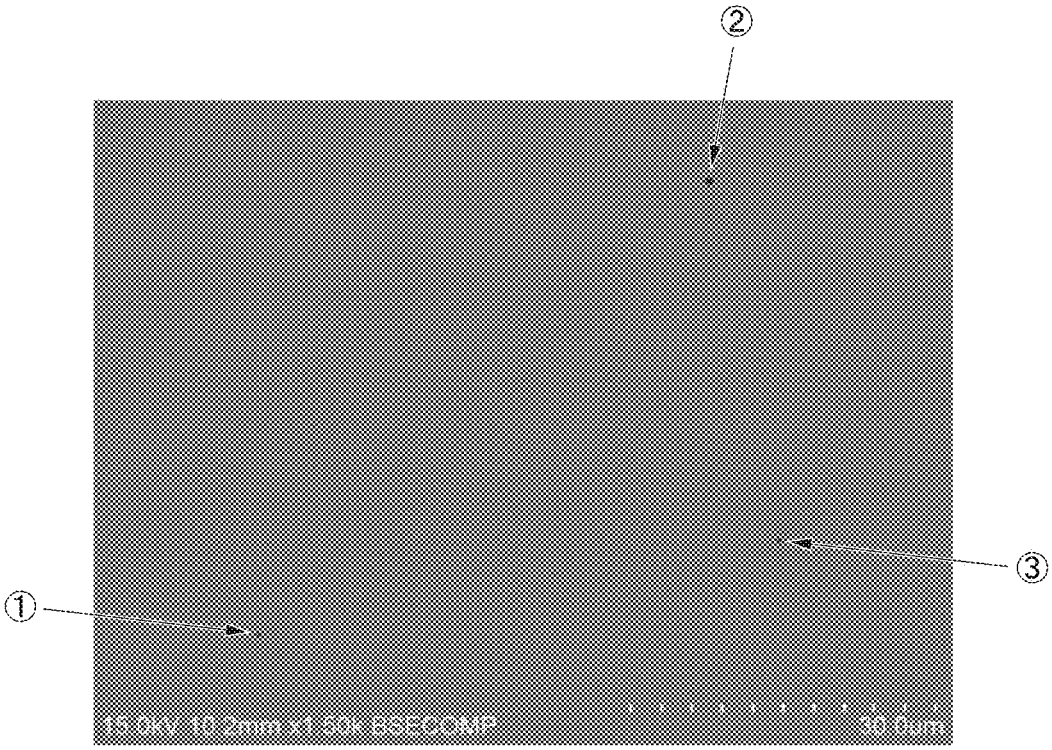
FIG. 3 is a diagram showing SEM observation result and EDX analysis results of the copper ingot of the example.

The SEM observation and EDX analysis were performed with respect to the cross section of the obtained copper ingot (cross section of the copper ingot orthogonal to the casting direction) and presence or absence of the inclusions formed of the oxides containing carbon, phosphorus, and Cu was confirmed. Evaluation results are shown in Table 1. SEM observation results and EDX analysis results of inclusions of Invention Example 1 are shown in FIG. 3. In FIG. 3, the inclusions are assumed to be circles and a diameter which is assumed to be the diameter of this circle is set as the particle size.

TABLE 1

| | | Molten copper temperature (° C.) | | Ceramic | Analysis results (ppm by mass) | | | | Presence or | Electrical | Void | Surface |
|---|---|---|---|---|---|---|---|---|---|---|---|---|
| | | Casting launder | Tundish | foam filter | Carbon | Oxygen | Hydrogen | Phosphorus | absence of inclusions | conductivity (% IACS) | defects (number) | defects (number) |
| Invention Example | 1 | 1085° C. or higher and lower than 1100° C. | 1100° C. to 1150° C. | Installed | 0.4 | 8 | 0.7 | 17 | Present | 99 | 0 | 0 |
| | 2 | 1085° C. or higher and lower than 1100° C. | 1100° C. to 1150° C. | Installed | 0.7 | 5 | 0.6 | 25 | Present | 99 | 0 | 0 |
| | 3 | 1085° C. or higher and lower than 1100° C. | 1100° C. to 1150° C. | Installed | 0.9 | 9 | 0.4 | 34 | Present | 99 | 0 | 0 |
| Comparative Example | 1 | 1100° C. to 1150° C. | 1085° C. or higher and lower than 1100° C. | Installed | 1.4 | 5 | 0.5 | 24 | Absent | 99 | 12 | 12 |
| | 2 | 1100° C. to 1150° C. | 1100° C. to 1150° C. | Installed | 1.5 | 4 | 0.4 | 25 | Absent | 99 | 15 | 18 |
| | 3 | 1085° C. or higher and lower than 1100° C. | 1100° C. to 1150° C. | Not installed | 1.6 | 6 | 0.4 | 28 | Present | 99 | 10 | 8 |
| | 4 | 1085° C. or higher and lower than 1100° C. | 1100° C. to 1150° C. | Installed | 0.5 | 15 | 0.4 | 20 | Present | 99 | 8 | 9 |
| | 5 | 1085° C. or higher and lower than 1100° C. | 1100° C. to 1150° C. | Installed | 0.4 | 7 | 1.0 | 19 | Present | 99 | 7 | 10 |
| | 6 | 1085° C. or higher and lower than 1100° C. | 1100° C. to 1150° C. | Installed | 0.7 | 8 | 0.5 | 12 | Present | 100 | 8 | 15 |
| | 7 | 1085° C. or higher and lower than 1100° C. | 1100° C. to 1150° C. | Installed | 0.5 | 6 | 0.4 | 38 | Present | 95 | 0 | 0 |
| | 8 | 1085° C. or higher and lower than 1100° C. | 1085° C. or higher and lower than 1100° C. | Installed | 0.6 | 5 | 0.6 | 11 | Absent | 100 | 6 | 12 |

In Comparative Examples 1 and 2, the carbon content in the copper ingot exceeded 1 ppm by mass and the numbers of the void defects and the surface defects were great. This may be because the generation of voids due to CO and $CO_2$ could not be prevented.

In Comparative Example 3, the ceramic foam filter was not installed and the numbers of the void defects and the surface defects were great.

In Comparative Example 4, the oxygen content in the copper ingot exceeded 10 ppm by mass and the numbers of the void defects and the surface defects were great. This may be because the generation of voids due to $H_2O$, CO, and $CO_2$ could not be prevented.

In Comparative Example 5, the hydrogen content in the copper ingot exceeded 0.8 ppm by mass and the numbers of the void defects and the surface defects were great. This may be because the generation of voids due to $H_2$ and $H_2O$ could not be prevented.

In Comparative Example 6, the phosphorus content of the copper ingot was less than 15 ppm by mass and the numbers of the void defects and the surface defects were great. This may be because the generation of voids due to $H_2O$, CO, and $CO_2$ could not be prevented due to an insufficient decrease in the oxygen content.

In Comparative Example 7, the phosphorus content of the copper ingot and the copper wire material exceeded 35 ppm by mass and the electrical conductivity was significantly decreased.

In Comparative Example 8, the phosphorus content of the copper ingot was less than 15 ppm by mass and the numbers of the void defects and the surface defects were great. This may be because the generation of voids due to CO, and $CO_2$ could not be prevented due to an insufficient decrease in the oxygen content due to phosphorus. In Comparative Example 8, the inclusion formed of the oxide containing carbon, phosphorus, and Cu was not observed. It is guessed that the inclusion formed of the oxide containing carbon, phosphorus, and Cu was not formed, since the molten copper temperature of the tundish was set to be as comparatively low as 1085° C. or higher and lower than 1100° C. and thereby carbon was crystallized from the molten copper and became CO and $CO_2$.

On the other hand, in Invention Examples 1 to 3, the numbers of the void defects and the surface defects were small. As shown in FIG. 3, it was confirmed that the inclusions formed of the oxides containing carbon, phosphorus, and Cu existed.

This may be because the carbon content was set to be 1 ppm by mass or less, the oxygen content was set to be 10 ppm by mass or less, the hydrogen content was set to be 0.8 ppm by mass or less, the phrosohirous content was set to be 15 ppm by mass to 35 ppm by mass, and the inclusions formed of the oxides containing carbon, phosphorus, and Cu were included, whereby the generation of voids due to $H_2$, $H_2O$, CO, and $CO_2$ was prevented.

From the above-mentioned results of the confirmatory experiments, it was confirmed that, according to the present invention, it was possible to provide a copper ingot in which void defects were reliably decreased and which was casted by a belt-caster type continuous casting apparatus, and a copper wire material which was formed of this copper ingot and in which generation of surface defects was prevented.

INDUSTRIAL APPLICABILITY

According to the copper ingot of the present invention, since the void defects are reliably decreased, it is possible to produce a copper wire material in which generation of surface defects is prevented. In addition, according to the method for producing the copper ingot of the present invention, it is possible to reliably decrease the void defects of the copper ingot.

REFERENCE SIGNS LIST

13 CASTING LAUNDER
20 BELT-WHEEL TYPE CONTINUOUS CASTING APPARATUS (BELT-CASTER TYPE CONTINUOUS CASTING APPARATUS)
21 TUNDISH
30 COPPER INGOT
40 COPPER WIRE MATERIAL

The invention claimed is:

1. A copper ingot which is casted by a continuous casting rolling apparatus, the copper ingot comprising:
1 ppm by mass or less of carbon;
10 ppm by mass or less of oxygen;
0.8 ppm by mass or less of hydrogen;
15 ppm by mass to 35 ppm by mass of phosphorus; and
a balance of Cu and inevitable impurities,
wherein the copper ingot includes inclusions formed of oxides containing carbon, phosphorus, and Cu,
wherein the electrical conductivity of the copper ingot is 98% IACS or more.

2. A copper wire material which is formed by processing a copper ingot,
wherein the copper ingot which is casted by a continuous casting rolling apparatus, the copper ingot comprising:
1 ppm by mass or less of carbon;
10 ppm by mass or less of oxygen;
0.8 ppm by mass or less of hydrogen;
15 ppm by mass to 35 ppm by mass of phosphorus; and
a balance of Cu and inevitable impurities,
wherein the copper ingot includes inclusions formed of oxides containing carbon, phosphorus, and Cu,
wherein the electrical conductivity of the copper ingot is 98% IACS or more.

3. A method for producing the copper ingot according to claim 1,
wherein a ceramic foam filter is installed between a tundish which supplies molten copper to the continuous casting rolling apparatus, and a casting launder which transports molten copper to the tundish, and
wherein the method comprises:
in the casting launder, using carbon powder as a solid reducing agent and setting a molten copper temperature to be in a range of 1085° C. or higher and lower than 1100° C.; and
in the tundish, setting the molten copper temperature to be in a range of 1100° C. to 1150° C. without using a solid reducing agent and adding phosphorus.

4. The copper ingot according to claim 1, wherein
a diameter of the inclusion is 0.1 μm to 6 μm, and
the inclusions are dispersed with a density of 40 to $2000/mm^2$.

5. The method for producing the copper ingot according to claim 3,
wherein a diameter of the inclusion is 0.1 μm to 6 μm, and
the inclusions are dispersed with a density of 40 to $2000/mm^2$.

* * * * *